US010018311B2

(12) United States Patent
Bobbo et al.

(10) Patent No.: US 10,018,311 B2
(45) Date of Patent: Jul. 10, 2018

(54) LIGHTING DEVICE AND CORRESPONDING MOUNTING HOUSING, KIT AND METHOD

(71) Applicant: Osram GmbH, Munich (DE)

(72) Inventors: Simon Bobbo, Chirignago (IT); Alberto Zanotto, Padua (IT)

(73) Assignee: Osram GmbH, Munich (DE)

( * ) Notice: Subject to any disclaimer, the term of this patent is extended or adjusted under 35 U.S.C. 154(b) by 42 days.

(21) Appl. No.: 14/710,628

(22) Filed: May 13, 2015

(65) Prior Publication Data

US 2015/0330584 A1 Nov. 19, 2015

(30) Foreign Application Priority Data

May 13, 2014 (IT) ..... TO2014A0380

(51) Int. Cl.
*F21S 4/22* (2016.01)
*F21S 2/00* (2016.01)
(Continued)

(52) U.S. Cl.
CPC ..... *F21S 2/005* (2013.01); *F21K 9/20* (2016.08); *F21S 4/22* (2016.01); *F21S 8/043* (2013.01);
(Continued)

(58) Field of Classification Search
CPC ..... F21S 2/005; F21S 4/20; F21S 4/22; F21S 8/043; F21K 9/20; F21V 15/013; F21V 21/08
See application file for complete search history.

(56) References Cited

U.S. PATENT DOCUMENTS 5,193,895 A * 3/1993 Naruke ..... B60Q 1/323 362/249.01
6,186,645 B1 * 2/2001 Camarota ..... F21S 8/032 362/240
(Continued)

FOREIGN PATENT DOCUMENTS

CN 2665511 Y 12/2004
CN 2708107 Y 7/2005
(Continued)

OTHER PUBLICATIONS

Italien Search Report based on application No. TO20140380 (7 pages) dated Sep. 10, 2014.
(Continued)

*Primary Examiner* — Anh Mai
*Assistant Examiner* — Nathaniel Lee
(74) *Attorney, Agent, or Firm* — Viering Jentschura & Partner MBB

(57) ABSTRACT

A lighting device may include a strip-like carrier with a first and a second opposed faces with light radiation sources on the first face, and a strip-like profiled member having a pi-shaped cross section, including a channel-like central portion with a bottom wall and side walls. The strip-like carrier is arranged in the profiled member with the first face and the light radiation sources facing outwardly of the central portion and the second face facing the bottom wall of central portion. The pi-shaped profiled member includes two sidewise extensions laterally to the central portion, to provide lateral fixing formations for the lighting device.

9 Claims, 2 Drawing Sheets

(51) Int. Cl.

| | |
|---|---|
| ***F21V 21/08*** | (2006.01) |
| ***F21S 8/04*** | (2006.01) |
| ***F21V 15/01*** | (2006.01) |
| ***F21K 9/20*** | (2016.01) |
| *F21S 4/20* | (2016.01) |
| *F21V 31/04* | (2006.01) |
| *F21V 19/00* | (2006.01) |
| *F21Y 103/10* | (2016.01) |
| *F21Y 115/10* | (2016.01) |

(52) U.S. Cl.
CPC ..... *F21V 15/013* (2013.01); *F21V 21/08* (2013.01); *F21V 19/005* (2013.01); *F21V 31/04* (2013.01); *F21Y 2103/10* (2016.08); *F21Y 2115/10* (2016.08); *Y10T 29/49004* (2015.01)

(56) References Cited

U.S. PATENT DOCUMENTS

| | | | | |
|---|---|---|---|---|
| 7,213,941 | B2 * | 5/2007 | Sloan | F21V 21/005 362/20 |
| 2004/0223328 | A1 * | 11/2004 | Lee | B60Q 1/2607 362/249.01 |
| 2007/0285922 | A1 | 12/2007 | Chen | |
| 2009/0185379 | A1 * | 7/2009 | Chen | F21V 3/00 362/294 |
| 2011/0110077 | A1 | 5/2011 | Klus | |
| 2013/0242570 | A1 | 9/2013 | Chen et al. | |

FOREIGN PATENT DOCUMENTS

| | | | |
|---|---|---|---|
| CN | 201047516 | Y | 4/2008 |
| CN | 202691736 | U | 1/2013 |
| CN | 202791560 | U | 3/2013 |
| CN | 103307472 | A | 9/2013 |
| DE | 202012011549 | U1 | 4/2013 |
| TW | M 309051 | U | 4/2007 |
| WO | 2010130141 | A1 | 11/2010 |
| WO | 2011139768 | A2 | 11/2011 |

OTHER PUBLICATIONS

Chinese Office Action based on application No. 201510232633.X (7 pages and 7 pages of English translation) dated Jul. 7, 2017.
Chinese Office Action based on application No. 201510232633.X (8 pages) dated Jan. 26, 2018.

* cited by examiner

LIGHTING DEVICE AND CORRESPONDING MOUNTING HOUSING, KIT AND METHOD

CROSS-REFERENCE TO RELATED APPLICATION

This application claims priority to Italian Patent Application Serial No. T02014A000380, which was filed May 13, 2014, and is incorporated herein by reference in its entirety.

TECHNICAL FIELD

Various embodiments may relate to lighting devices.

Various embodiments may be applied, for example, to lighting devices which employ, as light radiation sources, solid-state radiation sources such as LED sources.

BACKGROUND

An ever-growing interest is being brought to lighting devices built as modules having solid-state light radiation sources, e.g. LEDs, which offer the possibility to modify the shape of the module, thanks to a general flexibility.

In various implementations, such a module is adapted to be mounted on a carrier (e.g. a mounting surface) by a bi-adhesive tape or through clips.

In various implementation, the bi-adhesive tape may be directly provided on the back of the module. This solution may involve various drawbacks, such as:

- the difficulty in obtaining an optimum adhesion between module and mounting surface,
- the relatively low reliability of this fixation mode, which may lead in time to a risk of detachment,
- the difficulty in installing the module without exerting a pressure on the electronic components thereof,
- the physical impossibility to move the module once it has been installed.

If clips are being used, it may be impossible to fix the flexible module throughout its length. Moreover, the clips may remain visible, with an aesthetically displeasing effect.

SUMMARY

Various embodiments aim at overcoming the previously outlined drawbacks.

In various embodiments, said object may be achieved thanks to a lighting device having the features specifically set forth in the claims that follow.

Various embodiments may also refer to a corresponding mounting housing, as well as to a corresponding mounting kit and to a corresponding method.

Various embodiments may advantageously offer one or more of the following possibilities:

- the flexible lighting module (so-called "flex" LED module) may be installed in a simple way, without the need to resort to adhesive tapes,
- there is no need to press the module when it is being installed onto a mounting surface, e.g. a metal plate,
- the lighting device can be removed and re-installed in another position,
- the shape, the length, the material and the colour of the housing may be customized, for example according to the user's needs or wishes,

- different systems can be chosen to fix the module as a whole, for example by screws, snap fit connections, etc.,
- it is possible to install accessories on the rigid housing.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
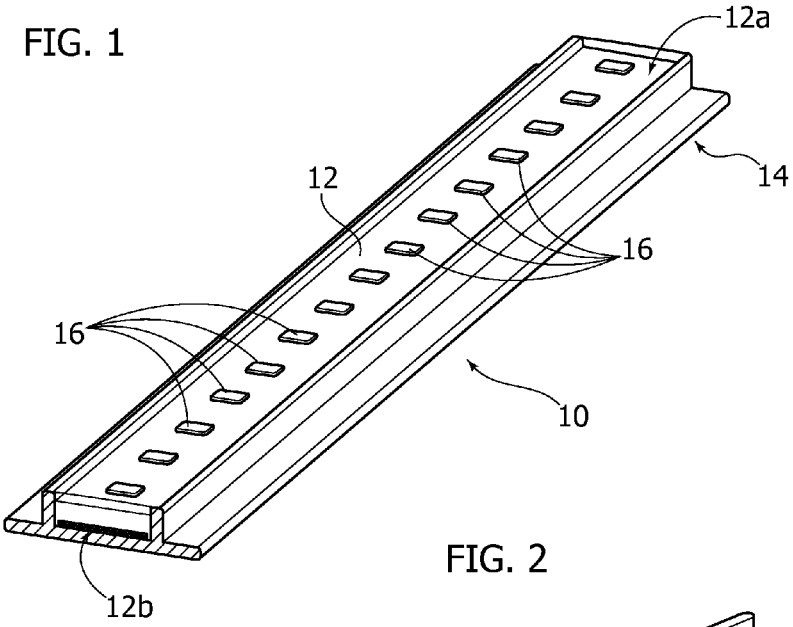
FIG. 1 is a perspective view of a lighting device according to various embodiments.

In the following description, numerous specific details are given to provide a thorough understanding of various exemplary embodiments. One or more embodiments may be practiced without one or more specific details, or with other methods, components, materials, etc. In other instances, well-known structures, materials, or operations are not shown or described in detail to avoid obscuring aspects of the embodiments. Reference throughout this specification to "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

In the Figures, reference 10 denotes on the whole a lighting device adapted, in one or more embodiments, to be implemented as a so-called "flex" module which employs electrically powered light radiation sources, e.g. solid-state light radiation sources such as LED sources.

Device 10 may therefore be a strip-like member of indefinite length, e.g. a strip-like module wound onto a spool, which may be cut to length according to the user's needs. A device of this kind can therefore have general features of flexibility, hence the name of "flex" module.

In various embodiments, device 10 may include other two strip-like members, denoted by 12 and 14 respectively.

Member 12 is a strip-like carrier member with a first face 12*a* and a second face 12*b;* member 12 is adapted to have, for example, a structure resembling a PCB (Printed Circuit Board), possibly with a layered structure, e.g. with a metal base layer, a plurality of solid-state light radiation sources 16 (e.g. LEDs) being mounted on the first face 12*a*.

The second member 14 is again a strip-like profiled member, that may have properties of flexibility.

In various embodiments, the profiled member 14 may be made of a material such as silicone, e.g. by extrusion.

Figure 2:
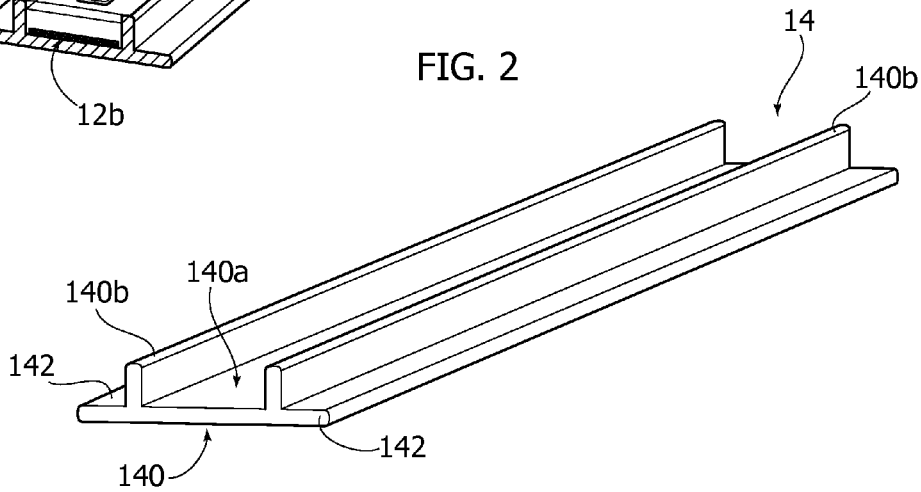
FIG. 2 shows in more detail one of the parts of the device of FIG. 1.

As will be appreciated from FIG. 2, wherein member 14 is shown alone, in various embodiments such a member may have a cross section in the form of a π (pi-shaped), shown upside down in FIG. 2. A "pi-shaped profile" is a profile having a shape substantially corresponding to the shape of letter π in the Greek alphabet.

In various embodiments, member 14 may include a central channel-like portion 140, with a bottom wall 140*a* and two side walls 140*b*.

Figure 3:
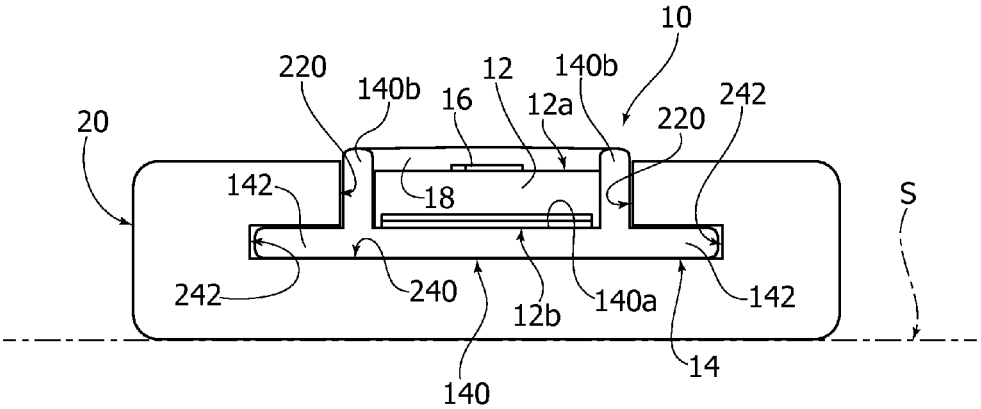
FIG. 3 shows a possible mounting solution of various embodiments.

As can be seen in FIG. 3, in various embodiments member 12 with the light radiation sources 16 is adapted to be inserted into the channel-like part 140 of profiled member 14 with:

the first face 12*a* and the light radiation sources 16 facing outwardly of the channel-like profile of central part 140, and the second face 12*b* facing towards the bottom wall 140*a* of channel-like portion 140.

In various embodiments, above member 12 there may be provided a potting mass 18 (for example a transparent silicone material) which seals the channel-like profile of portion 140 by enclosing member 12 within. Such member (which constitutes the actual lighting source) may therefore be provided with sealing properties towards the outer environment, e.g. with IP protection features.

In various embodiments, the pi-shaped profile of profiled member 14 may include two side extensions 142, which extend sidewise from central portion 140 (being substantially coplanar with bottom wall 140*a*), thus providing lateral fixing formations which may be used in order to mount device 10 according to a method which will be better detailed in the following.

In various embodiments, as exemplified in the Figures, side extensions 142 may extend continuously throughout the length of profile member 14.

In various embodiments, however, extensions 142 may include interruptions and/or extend only on a part of the length of profiled member 14.

It will be appreciated, moreover, that while being adapted to be mounted on mounting surface S according to criteria better detailed in the following, lighting device 10 may still be mounted in a traditional way, e.g. by using adhesive tapes or clips.

Figure 4:
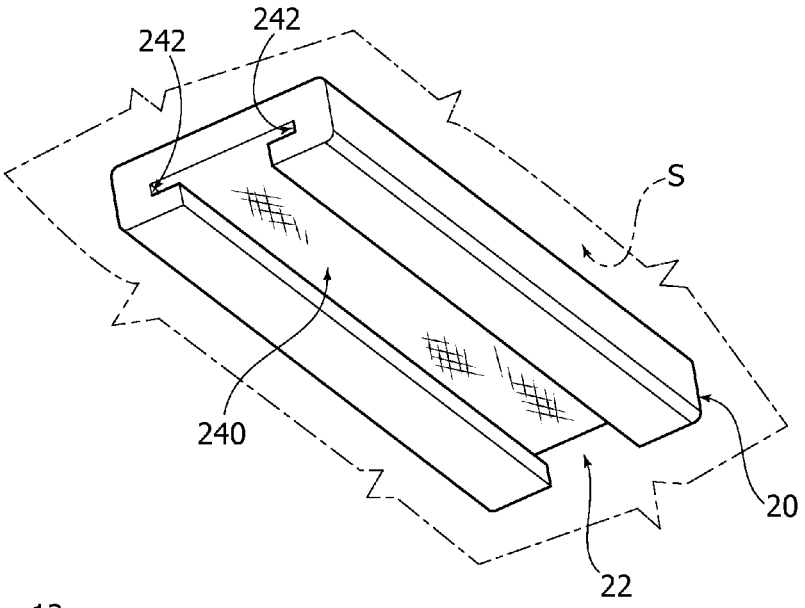
FIGS. 4 and 5 show possible mounting modes of various embodiments.
Figure 5:
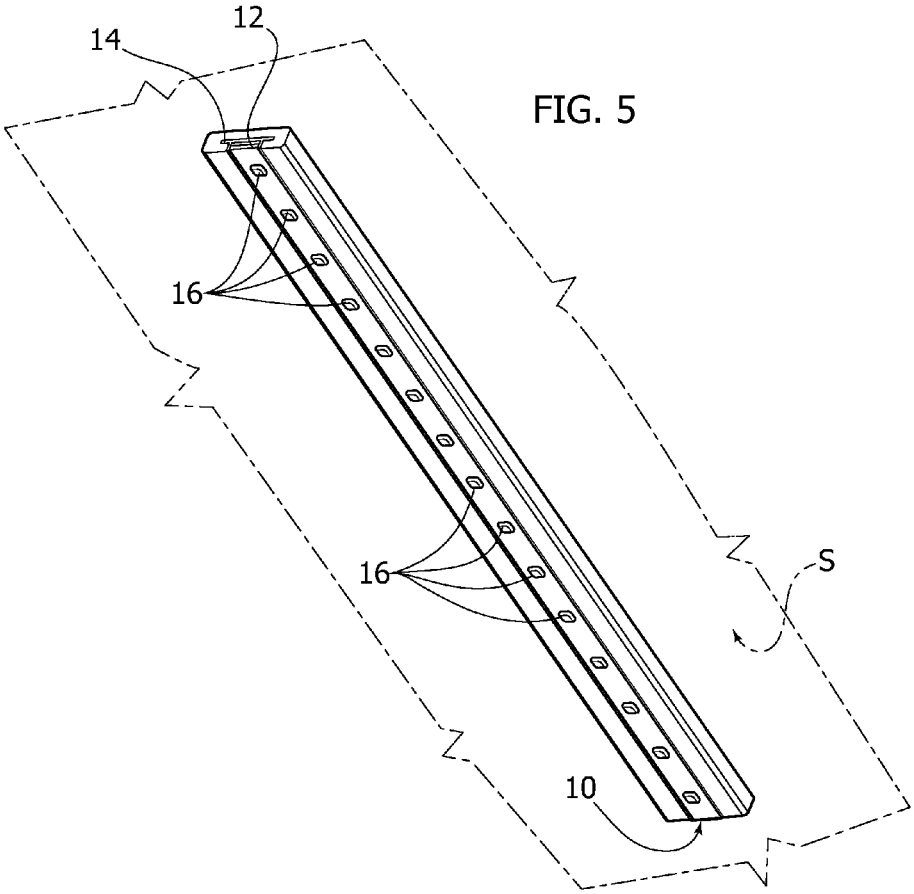

In various embodiments, a lighting device such as device 10 may be mounted on a mounting surface S, e.g. a wall (or a ceiling, as schematically exemplified in FIGS. 4 and 5), a piece of furniture, etc., by using a housing 20 as a mounting accessory.

In various embodiments, housing 20 may consist of another basically strip-like profiled member (which in one or more embodiments may constitute a substantially rigid body).

In various embodiments, housing 20 may include a longitudinal cavity (22) extending throughout the length of member 20, being adapted to receive device 10 therein, e.g. thanks to a profile having on the whole a C-shaped cross section.

To this end, as can be seen for example in FIG. 3, longitudinal cavity 22 adapted to receive device 10 therein may have two parallel side surfaces 220, extending longitudinally of housing 20, and a bottom surface 240 extending between side surfaces 220.

In various embodiments there may be present two sidewise, e.g. symmetrically, extending grooves 242, on the sides of bottom surface 240 in the length direction of housing 20. As exemplified in FIG. 5, grooves 242 are adapted to receive therein said sidewise extensions 142 of profiled body 14 of device 10.

In various embodiments, lighting module (flexible LED module) 10 may be inserted from the front end into housing 20, by placing the sidewise extensions 142 so as to correspond with grooves 242, and by sliding device 10 and housing 20 one relatively to the other.

This relative sliding movement may be performed without the need to press or bend module 10, which prevents all risks of damage e.g. of light radiation sources 16 and of the associated electric circuit arranged on carrier 12, while ensuring a reliable fixation of device 10 within housing 20.

In various embodiments, housing 20 may be implemented as a rigid body, e.g. by resorting to a plastic metal material.

In various embodiments, housing 20 may be obtained by extrusion as well, which lowers the cost of its production.

In various embodiments, the extruded material may be aluminium, which can be easily anodized.

These diverse options offer the possibility to achieve an aesthetically pleasing effect, e.g. with the possibility to customize the final product according to the application requirements and the user's taste.

As in the case of lighting device 10, housing 20 may be produced as a member of indefinite length (e.g. as a bar) which may be cut to length according to the application requirements.

In order to fix housing 20 to mounting surface S one can resort to different solutions, e.g. a fixation through screws, e.g. by including through holes for screws (not shown in the drawings) in bottom wall 240 of housing 20. Housing 20 may be fixed to surface S in various ways, e.g. by coupling it with clips or other snap-fit methods.

In various embodiments, housing 20 is moreover adapted to the mounting of accessories, for example a diffuser screen mounted on the front face, so as to obtain a diffusion effect of the light emitted by sources 16.

In various embodiments, first of all housing 20 is fixed to mounting surface S, and then it receives lighting device 10 therein, for example through sliding. This mounting method, moreover, enables to replace a device 10 with a device with different features. For example, it becomes possible to replace lighting device 10 with a device carrying radiation sources 16 with different colour characteristics, different radiation patterns, a different spacing of sources 16 on carrier 20, etc.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method of mounting a lighting device on a mounting surface, the method comprising:

providing a lighting device comprising:

a strip-like carrier member with first and second opposed faces with light radiation sources provided on said first face, a strip-like profiled member having a pi-shaped cross section including a channel-like central portion with a bottom wall and lateral side walls, wherein:

said strip-like carrier member is arranged in said pi-shaped profiled member with said first face and said light radiation sources facing outwardly of said central portion and said second face facing the bottom wall of said channel-like central portion, said pi-shaped profiled member includes two extensions sidewise of said central portion to provide lateral fixing formations for the lighting device, both of said carrier member and said pi-shaped profiled member are flexible, and a potting mass above said strip-like carrier member sealing the channel-like profile of said central portion of the strip-like profiled member by enclosing said strip-like carrier member, the method comprising:

providing a mounting housing, wherein the mounting housing has a strip-like body having a longitudinal cavity;

wherein the longitudinal cavity extends throughout the length of the mounting housing, applying said mounting housing on said mounting surface, coupling the lighting device to said mounting housing by causing said sidewise extensions of the pi-shaped profiled member of the lighting device to extend in opposed grooves of said mounting housing.

2. The method of claim 1, further comprising coupling said lighting device to said mounting housing by a relative longitudinal movement of said lighting device and said mounting housing.

3. The method of claim 1, wherein said applying said mounting housing on said mounting surface precedes said coupling said lighting device with said mounting housing.

4. A lighting device, comprising:

a strip-like carrier member with first and second opposed faces with light radiation sources provided on said first face, a strip-like profiled member having a pi-shaped cross section including a channel-like central portion with a bottom wall and lateral side walls, wherein:

said strip-like carrier member is arranged in said pi-shaped profiled member with said first face and said light radiation sources facing outwardly of said central portion and said second face facing the bottom wall of said channel-like central portion, said pi-shaped profiled member includes two extensions sidewise of said central portion to provide lateral fixing formations for the lighting device, both of said carrier member and said pi-shaped profiled member are flexible, and a potting mass above said strip-like carrier member sealing the channel-like profile of said central portion of the strip-like profiled member by enclosing said strip-like carrier member a lighting device mounting housing having a strip-like body having a longitudinal cavity therein, wherein:

said longitudinal cavity extends throughout the length of the lighting device mounting housing, said longitudinal cavity includes two parallel side surfaces and a bottom surface with opposed grooves extending sidewise of said bottom surface longitudinally of the strip-like body, and said grooves are adapted to receive said sidewise extensions of the pi-shaped profiled member of the said lighting device.

5. The lighting device of claim 4, wherein said sidewise extension extends over the whole length of said pi-shaped profiled member.

6. The lighting device of claim 4, wherein said pi-shaped profiled member includes a silicone material.

7. The lighting device of claim 4, wherein said potting mass includes a transparent silicone material.

8. The lighting device of claim 4, wherein said lateral side walls are parallel to each other and extend perpendicularly from the bottom wall of the central portion.

9. The lighting device of claim 1, wherein said lateral side walls are parallel to each other and extend perpendicularly from the bottom wall of the central portion.

* * * * *